US005554046A

United States Patent [19]

Sugiyama et al.

[11] Patent Number: 5,554,046

[45] Date of Patent: Sep. 10, 1996

[54] SOLDERLESS TERMINAL

[75] Inventors: Osamu Sugiyama; Sakai Yagi, both of Shizuoka, Japan

[73] Assignee: Yazaki Corporation, Tokyo, Japan

[21] Appl. No.: 362,898

[22] Filed: Dec. 23, 1994

[30] Foreign Application Priority Data

Dec. 24, 1993 [JP] Japan ..... 5-345909

[51] Int. Cl.[6] ..... H01R 4/24

[52] U.S. Cl. ..... 439/397; 439/395; 439/398

[58] Field of Search ..... 439/397, 396, 439/395, 398

[56] References Cited

U.S. PATENT DOCUMENTS

| | | | |
|---|---|---|---|
| 4,097,196 | 6/1978 | Over et al. | 439/398 |
| 4,973,261 | 11/1990 | Hatagishi et al. | 439/397 |
| 5,427,544 | 6/1995 | Okabe | 439/397 |

FOREIGN PATENT DOCUMENTS

| | | | |
|---|---|---|---|
| 279508A1 | 8/1988 | European Pat. Off. | 439/397 |

*Primary Examiner*—P. Austin Bradley

*Assistant Examiner*—Jeffrey T. Knapp

*Attorney, Agent, or Firm*—Sughrue, Mion, Zinn, Macpeak & Seas

[57] ABSTRACT

A solderless terminal for interconnecting a terminal to a lead wire in which the terminal has superior mechanical strength to enable the plate material used in manufacturing the terminal to have a minimum thickness thus reducing the overall size and weight of the terminal. The solderless terminal includes an electrical contact portion engageable with a mating connecting terminal and a conductor connecting portion having at least two core-wire contact slots longitudinally spaced from each other. Each of the core-wire contact slots is defined by a pair of opposing conductor clamping blades adapted to cut an insulating cover of a lead wire and retain the conductor of the lead wire to thereby electrically connect the terminal to the conductor. The terminal also includes first and second constricted portions each having a cubic shape defined by a bottom plate and opposing side walls which are bent inwardly to form right and left reinforcing walls. The conductor connecting portion has right and left side walls to accommodate a part of the lead wire. The end portions of the right and left side walls are bent inwardly substantially in the same direction as the reinforcing walls of the constricted portions to form the conductor clamping blades.

16 Claims, 9 Drawing Sheets

SOLDERLESS TERMINAL

BACKGROUND OF THE INVENTION

1. Field of the Invention

This invention relates to a solderless terminal which is adapted to be electrically connected to an insulated lead wire without removal of the insulating cover, and more particular to an improvement of the solderless terminal which results in miniaturization and increased mechanical strength.

2. Background

A variety of solderless terminals have been proposed in the art because they can be readily connected to lead wires. A number of such solderless terminals are shown in FIGS. 15 through 21.

The solderless terminal shown in FIGS. 15 and 16 has been disclosed in Japanese (unexamined) Utility Patent Application No. 142463/1985. The solderless terminal 1 comprises a front end portion including an electrical contact portion 2 which is engaged with a mating connecting terminal; a rear end portion including a lead-wire fixing portion 7 having right and left crimping pieces 5 and 6 which are designed to be crimped around the insulating cover 3 of a lead wire 4; a conductor connecting portion 9 provided between the electrical contact portion 2 and the lead wire fixing portion 7 which is electrically connected to the conductor 8 of the insulated lead wire 4 (hereinafter referred to as "a core-wire 8", when applicable); a first constricted portion 10 provided between the electrical contact portion 2 and the conductor connecting portion 9; and a second constricted portion 11 provided between the conductor connecting portion 9 and the lead-wire fixing portion 7. The terminal including the above parts is a single piece stamped out of a sheet of conductive metal plate.

The conductor connecting portion 9 includes front and rear plate-shaped contact pieces 14 each having a core-wire contact slot 13 which are spaced from each other in the direction along the longitudinal axis of the terminal 1. The plate-shaped contact pieces 14 are formed by raising portions of the bottom 15 of the press-contact terminal 1. Each of the plate-shaped contact pieces 14 include right and left clamping blades 17 which define the core-wire contact slot 13 between them. The clamping blades 17 function to cut the insulating cover 3 of the insulated lead wire 4 and retain the core-wire 8, so that the solderless terminal 1 is electrically connected to the conductor 8 of the insulated lead wire 4 which is fixedly held by the lead-wire fixing portion 7 of the terminal 1.

FIGS. 17 and 18 show another conventional solderless terminal, which has been disclosed in U.S. Pat. No. 4,385,794. The solderless terminal 20 is fundamentally the same as the one shown in FIG. 15. That is, the solderless terminal 20 is also formed as one piece by stamping out a piece of conductive metal plate, and it comprises: a front end portion including an electrical contact portion 2 which is adapted to be engaged with a mating connecting terminal; a rear end portion including a lead wire fixing portion 7 having right and left crimping pieces 5 and 6 which are designed to be crimped around the insulated cover 3 of the lead wire; a conductor connecting portion 9 provided between the electrical contact portion 2 and the lead wire fixing portion 7 which is electrically connected to the conductor of the insulated lead wire; a first constricted portion 10 between the electrical contact portion 2 and the conductor connecting portion 9; and a second constricted portion 11 between the conductor connecting portion 9 and the lead-wire fixing portion 7. The conductor connecting portion 9 includes conductor clamping blades 17 confronting with each other to define core-wire contact slots 13 which are spaced from each other in the direction of the longitudinal axis of the terminal.

However, it should be noted that, in the solderless terminal 20, the first and second constricted portions 10 and 11 are merely flat plates which are provided by using the bottom plate of the terminal. The conductor connecting portion 9, as shown in FIG. 18, includes right and left side walls 22 and 22 which are formed by bending both sides of the bottom plate 21. The front and rear end portions of those side walls 22 and 22 are bent inwardly so that they function as the aforementioned conductor clamping blades 17. The right and left side walls 22 and 22 define a lead-wire accommodating space 23 for accommodating the end portion of a lead-wire to be press-connected to the terminal. Cuts 24 are formed in the ridges of the conductor connecting portion 9 where the bottom plate 21 meets the right and left side walls 22, to increase the mechanical strength thereof.

Other conventional solderless terminals, shown in FIGS. 19 and 20, and in FIG. 21, have been disclosed in Japanese (unexamined) Utility Patent Application No. 35266/1988. The solderless terminal 26 shown in FIGS. 19 and 20 is obtained by improving the pressure-connect type terminal 20 shown in FIG. 17. That is, the right and left side walls 22 and 22 of the conductor connecting portion 9 have cut-outs which allows the insulating cover 3 of the insulated lead wire 4 to expand when the latter is compressed. Similarly as in the case of the solderless terminal 20 shown in FIG. 17, the front and rear end portions of the side walls 22 are bent inwardly, to form conductor clamping blades 17.

The solderless terminal 27 shown in FIG. 21 represents a slight modification of the solderless terminal 26 shown in FIG. 19. That is, in order to increase the mechanical strength of the side walls 22 of the conductor connecting portion 9, the cut-outs 28 are modified into rectangular windows leaving the outer edge portions of the side walls.

The above-described solderless terminals are generally produced on a large scale. Therefore, even if the degree of miniaturization and amount of reduction in weight of each of the solderless terminals are small, the miniaturization and the weight reduction greatly contribute to the economical use of the material. On the other hand, the solderless terminals are, in general, used as follows: A number of solderless terminals are arranged in side-by-side relationship within a connector. Therefore, even if the degree of miniaturization per solderless terminal is small, the connector can be greatly miniaturized.

Thus, in the connector art, intensive research has been conducted in miniaturizing solderless terminals, and in reducing the thickness of the metal plates to be used for fabricating such terminals.

In the solderless terminal 1 shown in FIGS. 15 and 16, in order to prevent the conductor clamping blades 17 from being deflected outwardly by the pressure applied thereto when the conductor 8 of the lead wire is pushed into the core-wire contact slots 13, the conductor clamping blades 17 defining the core-wire contact slots 13 are formed by upwardly bending the portions of the bottom plate 15 between the right and left side walls 29 and 29 of the conductor connecting portion 9. Hence, in order to miniaturize the solderless terminal, it is essential to reduce the width h of each of the conductor clamping blades 17. However, the reduction of the width h is considerably difficult, because, in a blanking process and in a bending process using a jig to form the solderless terminal, the processing accuracy is limited, and accordingly dimensions to be handled are limited. Thus, miniaturization of the solderless terminal 21 shown in FIGS. 15 and 16 is not practical.

As was described above, the solderless terminals 20, 26 and 27 shown in FIGS. 17 through 21 include the constricted portions 10 and 11. These portions 10 and 11 are simple flat plates, which are parts of the bottom plate, and therefore lower in mechanical strength than the other portions. Hence, if the weight of the solderless terminal is reduced by decreasing the thickness of the plate material used, then the constricted portions 10 and 11 may be deformed or damaged when the terminals thus formed are inserted into the connector housing.

In the solderless terminals 26 and 27 shown in FIGS. 19 and 20, and 21, the side walls 22 have the cut-outs 28 formed therein. The formation of the cut-outs 28 lowers the joining strength between the side walls 22 and the bottom plate. Hence, when the conductor of the lead wire is inserted into the core-wire contact slots 23, the pressure applied to the conductor clamping blades 17 tends to concentrate on the junctions (bent parts) between the bottom plate and the front and rear end portions of the side walls 22. Therefore, if the plate material to be used for fabricating of the terminal is reduced in thickness, the mechanical strength will be attendantly decreased as described above. As a result, when the conductor of the lead wire is pushed into the core-wire contact slots, the conductor clamping blades 17 will be urged outwardly from each other, thus adversely affecting the press-connection of the terminal to the conductor of the lead wire.

Accordingly, an object of the invention is to eliminate the above-described difficulties accompanying conventional solderless terminals. More specifically, an object of the invention is to provide a solderless terminal in which its portions which are heretofore low in mechanical strength, such as the first constricted portion between the electrical contact portion, the conductor connecting portion and the second constricted portion between the conductor connecting portion and the lead-wire fixing portion, are increased in mechanical strength, whereby, even when the terminal is reduced in size and in weight by decreasing the thickness of a plate material to be used for fabrication of the terminal, the terminal remains mechanically strong. Therefore, the terminal will remain electrically connected to the conductor of the insulated lead wire with high reliability at all times.

SUMMARY OF THE INVENTION

The foregoing object of the invention has been achieved by the provision of a solderless terminal comprising: an electrical contact portion which is a front end portion of the terminal and is engaged with a mating connecting terminal; a conductor connecting portion which has at least two core-wire contact slots which are spaced apart from each other along the longitudinal axis of the terminal, each core-wire contact slots being defined by a pair of conductor clamping blades confronted with each other which are adapted to cut the insulating cover of a lead wire and hold the conductor of the lead wire thereby to electrically connect the terminal to the conductor of the lead wire; a first constricted portion merging with the front of the conductor connecting portion; and a second constricted portion merging with the rear of the conductor connecting portion. According to the invention, each of the first and second constricted portions is of a cubic structure with both sides thereof being bent inwardly to form right and left reinforcing walls, the conductor connecting portion has right and left side walls which are confronted with each other to accommodate a part of the lead wire which is to be pushed in the conductor connecting portion, and the front and rear end portions of the right and left side walls are bent inwardly substantially in the same direction as the reinforcing walls of the constricted portions, to form conductor clamping blades.

In the solderless terminal, the right and left reinforcing walls of each of the first and second constricted portions may be bent so that the right and left reinforcing walls are folded over each other. Furthermore, in the terminal, recesses may be formed in the inner surfaces of the right and left side walls of the conductor connecting portion by stamping to permit the insulating cover of the lead wire to expand when the latter is pushed in the conductor connecting portion.

In the solderless terminal of the invention, the first constricted portion between the electric contact portion and the conductor connecting portion and the second constricted portion between the conductor connecting portion and the lead-wire fixing portion are each of a cubic structure with both sides of the bottom plate being bent inwardly to form the right and left reinforcing walls. The resultant constricted portions are much higher in mechanical strength than those of the conventional solderless terminal which are merely flat plates. Hence, even when the solderless terminal is decreased in size and in weight by reducing the thickness of the plate material to be used in fabricating the terminal, the resultant terminal is free from the difficulty that, because of the reduction in thickness of the plate material, the terminal is reduced in mechanical strength, so that it is liable to be deformed.

In the conductor connecting portion, the conductor clamping blades forming the core-wire contact slots are formed by bending the side walls in such a manner that they are integral with the reinforcing walls of the constricted portions. Hence, the conductor clamping blades and the side walls are sufficiently high in mechanical strength. Therefore, even when the solderless terminal is decreased in size and in weight by reducing the thickness of the plate material to be used for fabrication of the terminal, the resultant terminal is high in mechanical strength, and the blades are prevented from being separated when the lead wire is forced in between them; that is, the terminal is maintained electrically connected to the conductor of the lead wire with high reliability.

In the first and second constricted portions, the reinforcing walls extending from both sides of the bottom plate are bent in such a manner that they are laid one on another. The bending of the reinforcing walls in this manner is able to increase the mechanical strength of the constricted portions more readily. Even when the solderless terminal is decreased in size and in weight by reducing the thickness of the plate material to be used for fabricating the terminal, the resultant terminal is free from the difficulty that it is decreased in mechanical strength, so that it is liable to be deformed. The side walls of the conductor connecting portion, being integral with the constricted portions, are increased in rigidity. Hence, the conductor clamping blades are more positively prevented from being separated from each other when the lead wire is forced in between them.

With the solderless terminal in which the side walls of the conductor connecting portion have the recesses formed in the inner surfaces, the insulating cover of the lead wire is allowed to expand in the recesses when the lead wire is pushed in between the side walls, which reduces the load which is applied to the side walls when the insulating cover expands, thereby to prevent the conductor clamping blades from being opened.

On the other hand, the formation of the recesses in the side walls of the conductor connecting portion results in a reduction in weight of the terminal itself. In addition, in the solderless terminal of the invention, the side walls of the conductor connecting portion are higher in mechanical strength than those in the conventional solderless terminal which have the cuts to allow the insulating cover to expand. Hence, the terminal of the invention is free from the difficulties associated with the side walls or the conductor clamping blades being deformed when the lead wire is pushed in between them.

DETAILED DESCRIPTION OF THE PREFERRED EMBODIMENTS

Figure 1:
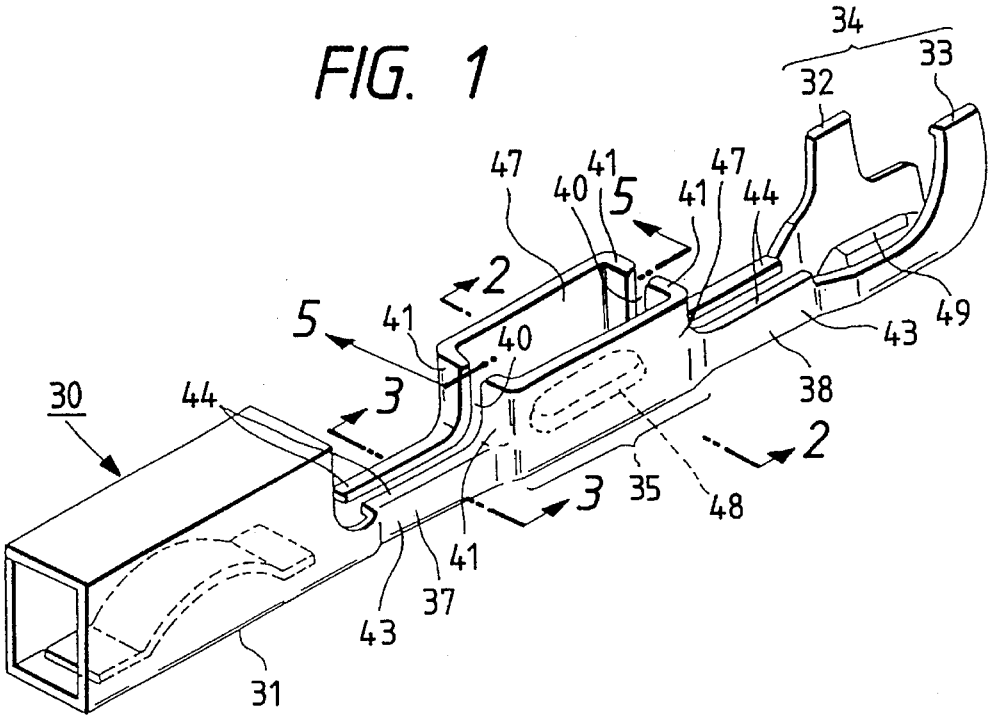
FIG. 1 is a perspective view showing an example of a solderless terminal, which constitutes a first embodiment of the invention.

FIGS. 1 through 5 shows a solderless terminal, which constitutes a first embodiment of the invention. The solderless terminal 30 comprises: a front end portion including an electrical contact portion 31 which is engageable with a mating connecting terminal; a rear end portion including a lead-wire fixing portion 34 having right and left crimping pieces 32 and 33 which are adapted to be crimped around and insulating cover 3 to thereby retain lead wire 4; a conductor connecting portion 35 provided between the electrical contact portion 31 and the lead wire fixing portion 34 to electrically connect the terminal 30 to the conductor 8 of the insulated lead wire 4 (hereinafter referred to as "a core-wire 8", when applicable); a first constricted portion 37 located between the electrical contact portion 31 and the conductor connecting portion 35; and a second constricted portion 38 located between the conductor connecting portion 35 and the lead-wire fixing portion 7. The terminal including the above elements is a single piece formed by stamping a sheet of conductive metal plate.

Figure 2:
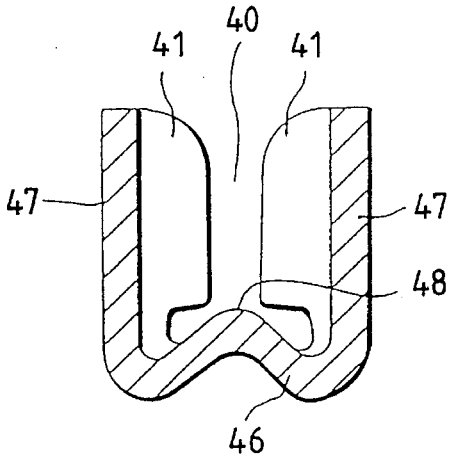
FIG. 2 is a sectional view taken along line 2—2 in FIG. 1.

The conductor connecting portion 35 includes two core-wire contact slots 40 and 40 which are longitudinally spaced away from each other between the electrical contact portion 31 and the lead-wire fixing portion 34, so as to retain the conductor of the lead wire. Each of the core-wire contact slots 30, as shown in FIG. 2, is defined by a pair of opposing conductor clamping blades 41. As the insulated lead wire is pushed into the core-wire contact slots 40, the conductor clamping blades 41 cut the insulating cover 3 of the lead wire 4 and clamp the conductor 8. In this manner, the terminal 30 is electrically connected to the conductor 8 of the insulated lead wire 4.

Figure 3:
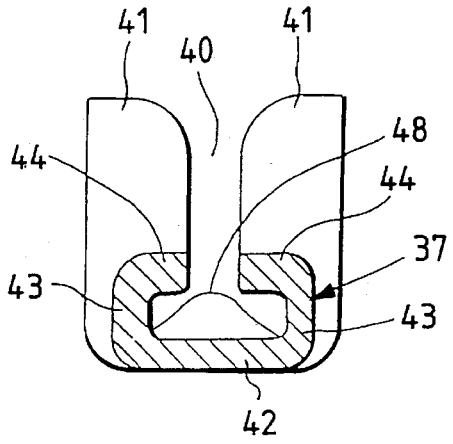
FIG. 3 is also a sectional view taken along line 3—3 in FIG. 1, showing a conductor connecting portion of the terminal according to the invention.

Each of the first and second constricted portions 37 and 38, as shown in FIG. 3, comprises first reinforcing walls 43 and 43 which are formed by bending the side walls of bottom plate 42 through 90° in such a manner that they extend upwardly from the bottom plate 42, and second reinforcing walls 44 and 44 which extend horizontally toward each other from the first reinforcing walls 43 and 43, respectively. That is, the first and second constricted portions 37 and 38 are substantially C-shaped in cross section.

The conductor connecting portion 35, as shown in FIGS. 1 and 2, includes a bottom plate 46 and right and left side walls 47 which extend upwardly from the right and left edges of the bottom plate 46, respectively, to partially encapsulate the part of an insulated lead wire 4 which is pushed in between them. The front and rear end portions of the side walls 47 are bent inwardly to form the aforementioned front and rear conductor clamping blades 41. The right and left side walls 47, the conductor clamping blades 41, and the reinforcing walls 43 and 44 of the first and second constricted portions 37 and 38 are formed integral with one another.

Figure 5:
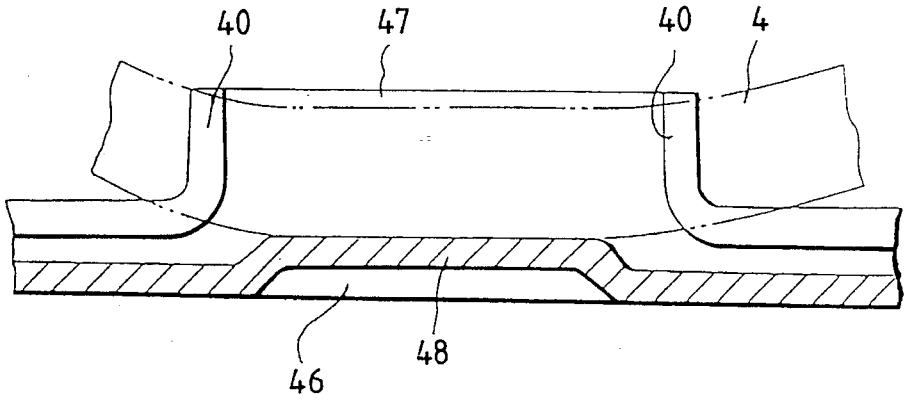
FIG. 5 is a sectional view taken along line 5—5 in FIG. 1.
Figure 6:
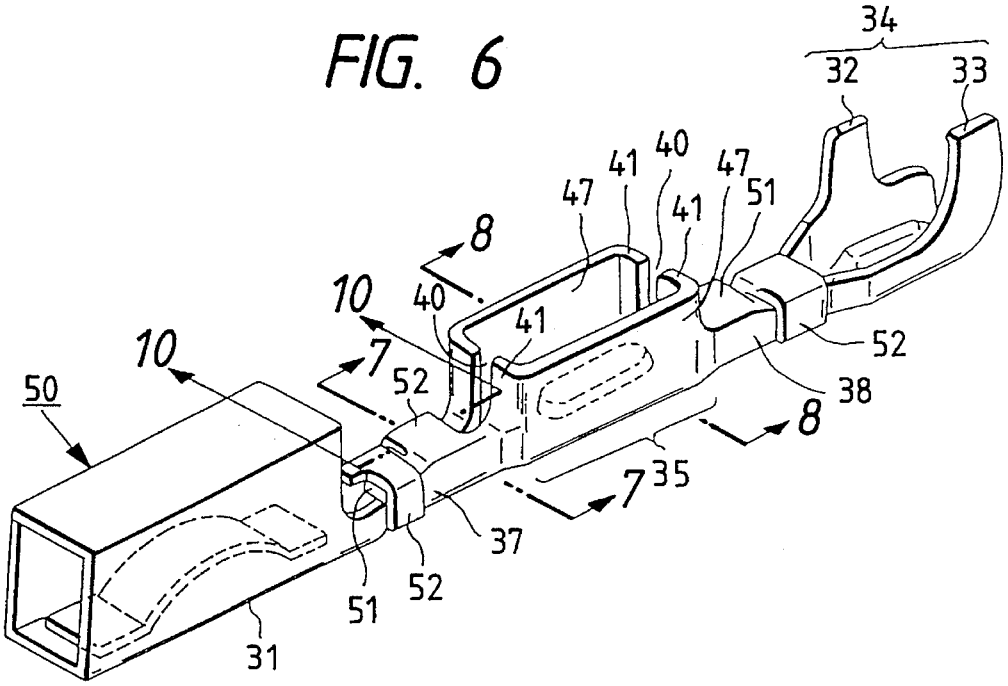
FIG. 6 is a perspective view showing another example of the solderless terminal, which constitutes a second embodiment of the invention.

As also shown in FIG. 5, a wire stopper 48 is formed on the bottom plate 46 of the conductor connecting portion 35 in such a manner that it extends longitudinally of an insulated lead wire 4 set therein. The wire stopper 48 determines the depth to which the lead wire 4 is pushed into the space defined between the right and left side walls 47 of the conductor connecting portion 35. Another wire stopper 49 similar to the stopper 48 is formed on the bottom plate of the lead-wire fixing portion 34, as shown in FIG. 1.

Figure 4:
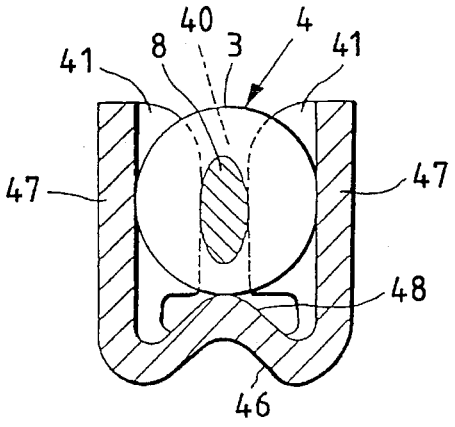
FIG. 4 is an explanatory diagram showing a lead wire which has been pushed in the conductor connecting portion shown in FIG. 3.

FIG. 4 shows a lead wire 4 which is forced into the conductor connecting portion 35 of the terminal 30. The conductor 8 of the lead wire 4 is held compressed by the conductor clamping blades 41 which define the core-wire contact slots 40. The insulating cover 3 of the lead wire 4 abuts against the wire stopper 48, thus preventing the lead wire 4 from being excessively pushed downward in the conductor connecting portion 35.

In the above-described solderless terminal 30, the first constricted portion 37 between the electrical contact portion 31 and the conductor connecting portion 35, and the second constricted portion 38 between the conductor connecting portion 35 and the lead-wire fixing portion 35 are each formed with the first and second reinforcing walls which are obtained by bending both sides of the bottom plate 42; that is, they are of a cubic structure. Thus, in the solderless terminal of the invention, those constricted portions 37 and 38 are greatly increased in mechanical strength when compared with those of the conventional solderless terminal. Hence, even when the solderless terminal is decreased in size and in weight by reducing the thickness of the plate material to be used in fabricating the terminal, the resultant terminal is free from the difficulty that, because of the reduction in thickness of the plate material, the terminal is decreased in mechanical strength, so that it is liable to be deformed.

In the conductor connecting portion 35, the conductor clamping blades 41 defining the core-wire contact slots 40 are formed integral with the reinforcing walls 43 and 44 and side walls 47 of the constricted portions 37 and 38 by drawing. Therefore, the conductor clamping blades 41 and the side walls 47 are sufficiently high in mechanical strength. Therefore, even when the solderless terminal is decreased in size and in weight by reducing the thickness of the plate material to be used fabricating the terminal, the resultant terminal is free from the difficulty that the conductor clamping blades are forced away from each other when the core-wire is pushed in between them; that is, the terminal is maintained electrically connected to the conductor of the insulated lead wire with high reliability.

In the above-described embodiment, the wire stoppers 48 and 49 are provided on the bottom plates of the lead-wire fixing portion 34 and the conductor connecting portion 35, respectively, to limit the depth of insertion of the lead wire 4. This structure eliminates the possibility of the lead wire 4 being accidentally bent as a result of being urged too far into the terminal so that the conductor will not inadvertently be broken.

The constricted portions 37 and 38 have the above-described reinforcing walls; however, the invention is not limited thereto or thereby. That is, the constricted portions 37 and 38 may be modified as in the case of a solderless terminal 50 shown in FIGS. 6 through 10, which constitutes a second embodiment of the invention. In the solderless terminal 50, each of the first and second constricted portions 37 and 38 has right and left reinforcing walls 51 and 52 which extend on both sides of the bottom plate 42 and are lapped over each other.

Figure 7:
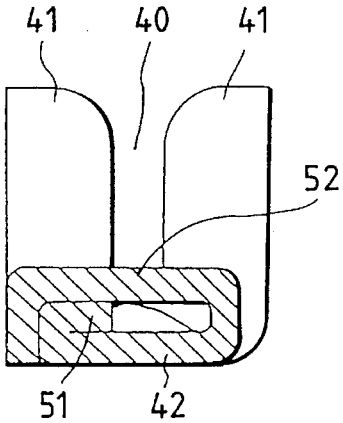
FIG. 7 is a sectional view taken along line 7—7 in FIG. 6.
Figure 8:
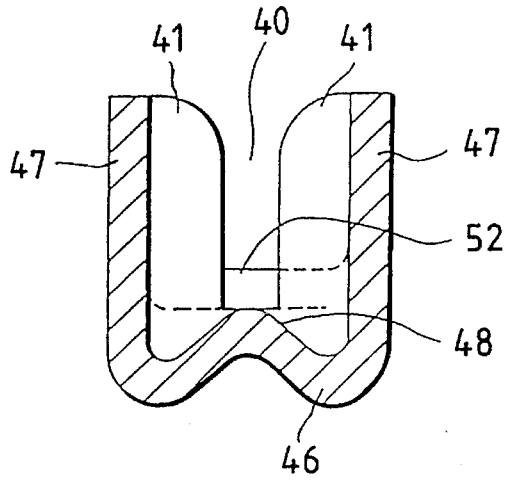
FIG. 8 is also a sectional view taken along line 8—8 in FIG. 6, showing a conductor connecting portion of the solderless terminal according to the invention.
Figure 9:
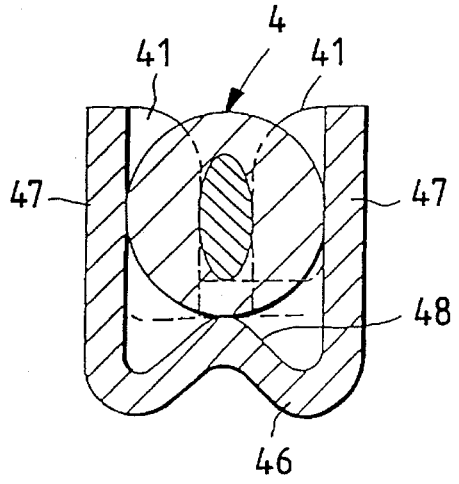
FIG. 9 is an explanatory diagram showing a lead wire which has been pushed in the conductor connecting portion shown in FIG. 8.
Figure 10:
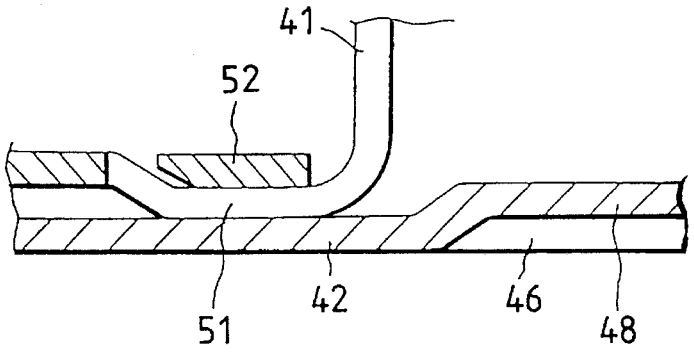
FIG. 10 is a sectional view taken along line 10—10 in FIG. 6.
Figure 11:
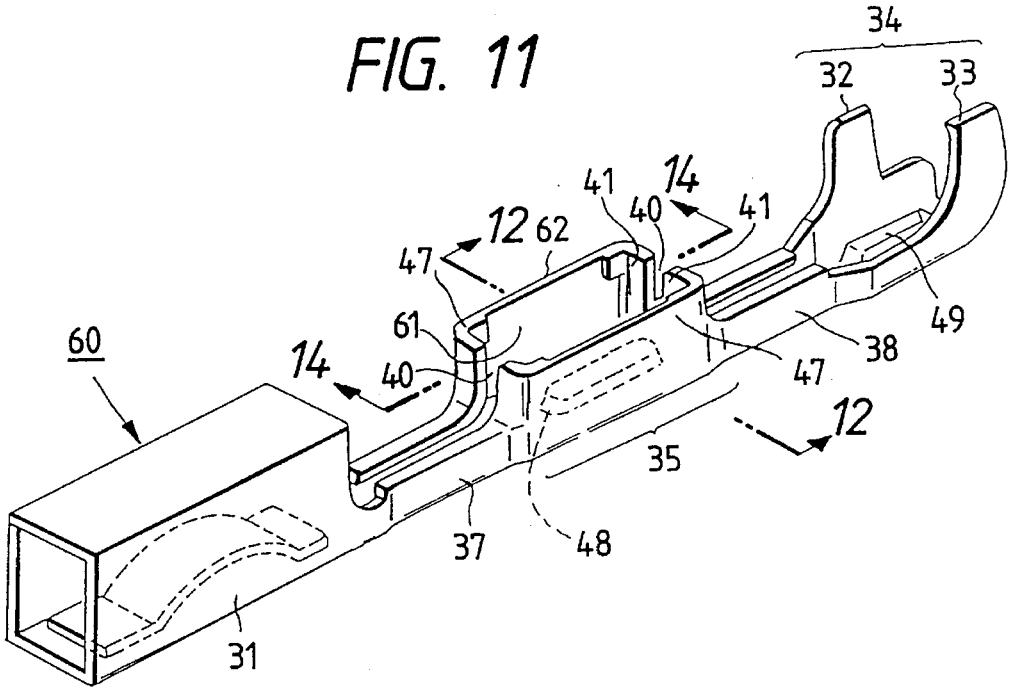
FIG. 11 is a perspective view showing another example of the solderless terminal, which constitutes a third embodiment of the invention.
Figure 12:
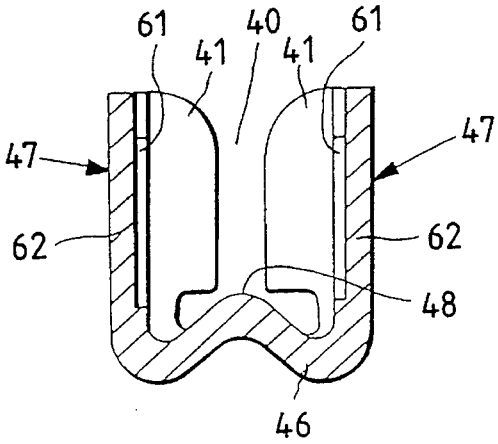
FIG. 12 is a sectional view taken along line 12—12 in FIG. 11, showing a conductor connecting portion of the terminal according to the invention.
Figure 13:
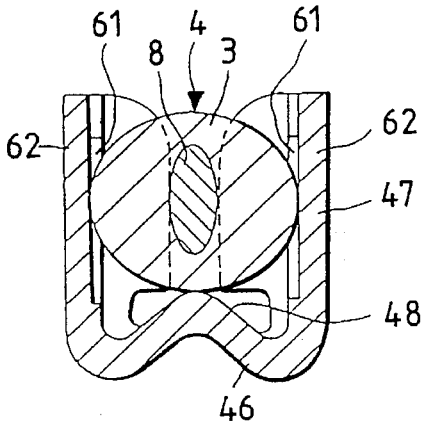
FIG. 13 is an explanatory diagram showing a lead wire which has been pushed in the conductor connecting portion shown in FIG. 12.

More specifically, as shown in FIG. 7 the reinforcing wall 51 extending on one side of the bottom plate 42 is relatively short, and it is folded over the bottom plate 42; while the reinforcing wall 52 extending on the other side of the bottom plate 42 is relatively long, and it is wrapped around the reinforcing wall 51. In FIGS. 6 to 10 showing the solderless terminal 50, parts corresponding functionally to those which have been described with reference to FIGS. 1 through 5 showing the solderless terminal 30 are therefore designated by the same reference numerals or characters.

Thus, in the solderless terminal 50, the constricted portions 37 and 38 are greatly increased in mechanical strength by the reinforcing walls 51 and 52. Hence, even when the solderless terminal is decreased in size and in weight by reducing the thickness of the plate material to be used for fabrication of the terminal, the resultant terminal is free from the difficulty that, because of the reduction in thickness of the plate material, the terminal is reduced in mechanical strength, so that it is liable to be deformed.

Since the end portion of the long reinforcing wall 52 is wrapped around the short reinforcing wall 51 up to the side surface, the two side walls 47 and 47 of the conductor connecting portion 35 which are integral with the constricted portions 37 and 38 are attendantly increased in rigidity; that is, the confronting side walls 47 and 47 are strengthened so that they are difficult to expand outwardly. Hence, the conductor clamping blades 41 are more positively prevented from being opened when the core-wire is pushed in between them.

Figure 14:
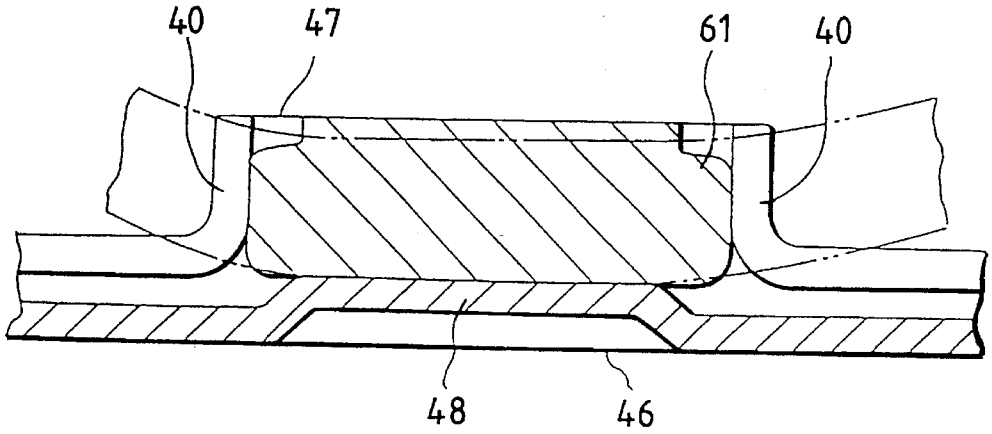
FIG. 14 is a sectional view taken along line 14—14 in FIG. 11.
Figure 15:
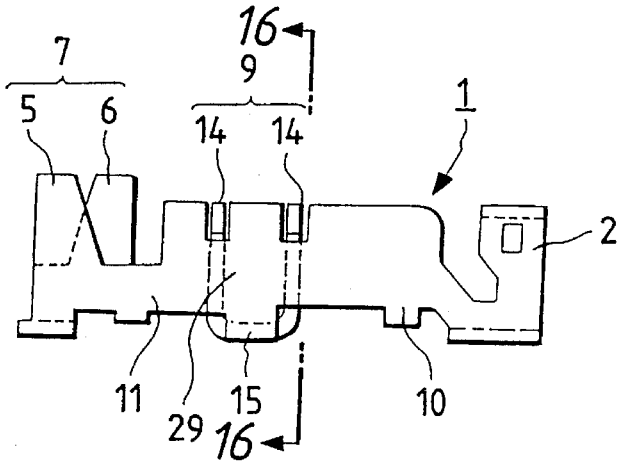
FIG. 15 is a side view showing one example of a conventional solderless terminal.
Figure 16:
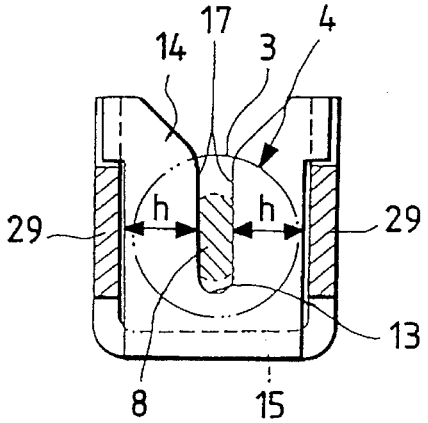
FIG. 16 is a sectional view taken along line 16—16 in FIG. 15.
Figure 17:
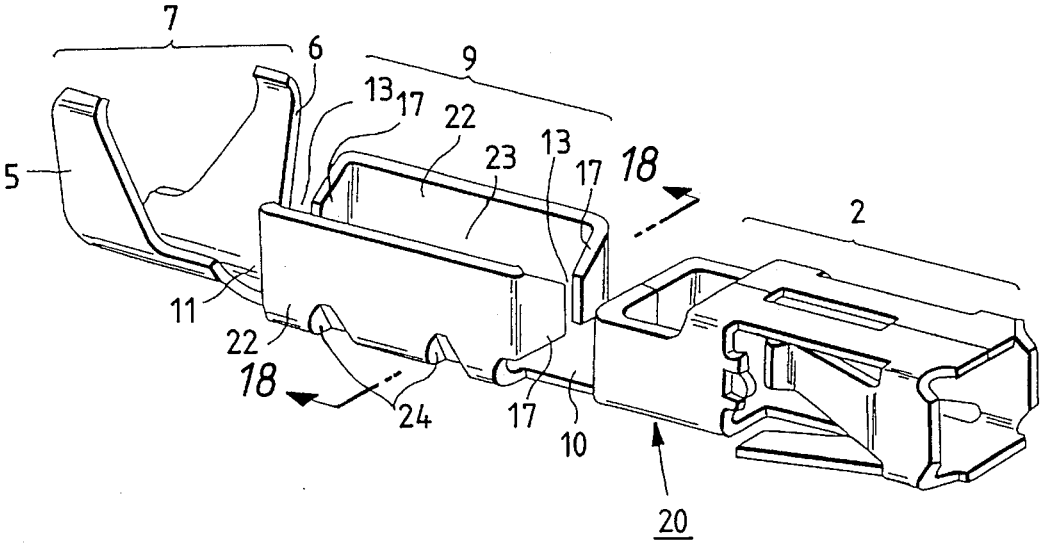
FIG. 17 is a perspective view showing another example of the conventional solderless terminal.
Figure 18:
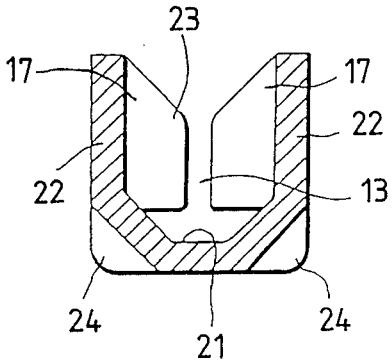
FIG. 18 is a sectional view taken along line 18—18 in FIG. 17.
Figure 19:
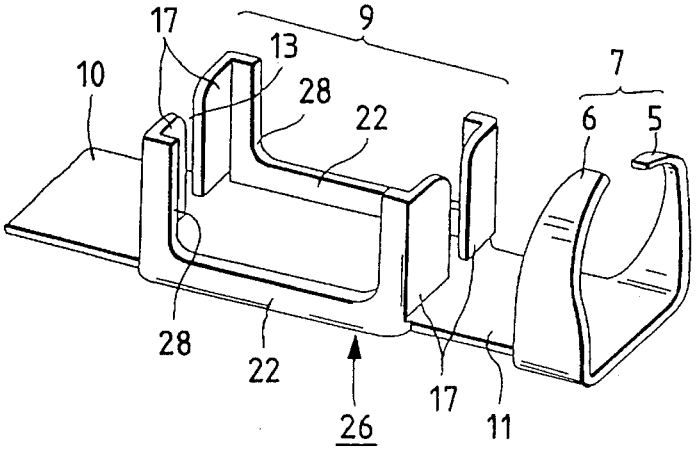
FIG. 19 is a perspective view showing another example of the conventional solderless terminal.
Figure 20:
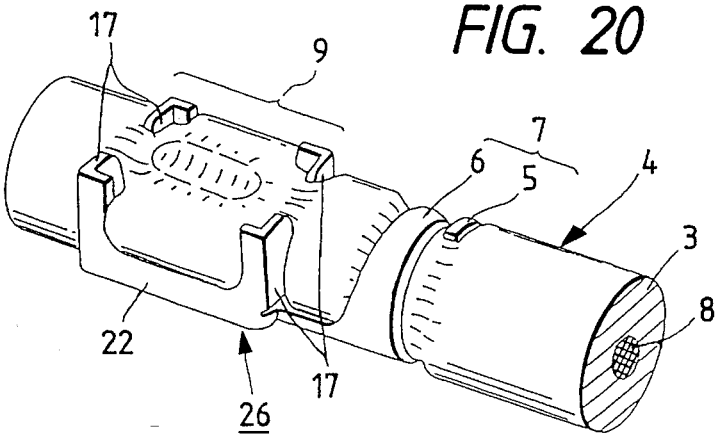
FIG. 20 is a perspective view of the conventional solderless terminal shown in FIG. 19 which has been connected to a lead wire.
Figure 21:
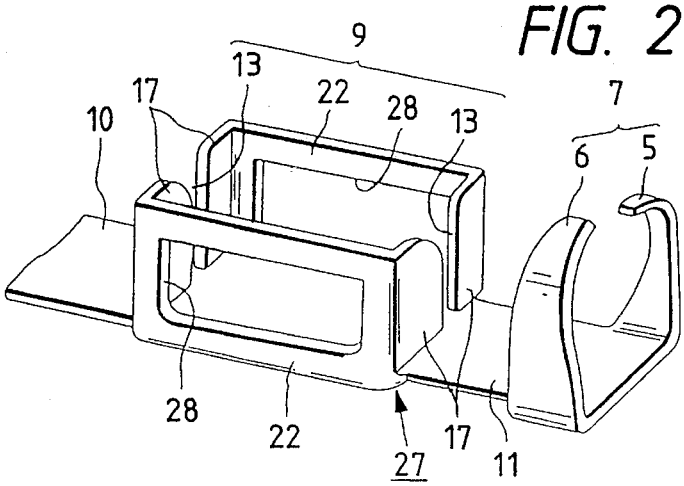
FIG. 21 is a perspective view of the solderless terminal shown in FIG. 19 which has been partially improved upon.

In the above-described solderless terminal 30 or 50, the two side walls 47 of the conductor connecting portion 35 are uniform in thickness; however, the invention is not limited thereto or thereby. That is, the side walls 47 may be modified, for instance, as in the case of the solderless terminal 60 shown in FIGS. 11 through 14. In the solderless terminal 60, the right and left side walls 47 and 47 of the conductor connecting portion 35 are partially decreased in wall thickness as indicated at 62; that is, they have recesses 61, respectively, which allow the insulating cover 3 of the lead wire 4 to expand when it is pushed in between the side walls 47. In the solderless terminal 60, as shown in FIG. 14, the recesses 61 are extended substantially over the entire width of the side walls 47 to increase the capacity of the conductor connecting portion to thereby permit the expansion of the insulating cover 3. However, it should be noted that the front and rear ends of the upper end portions of the two side walls are not decreased in wall thickness as indicated at 63, to improve the effect of preventing the conductor clamping blades 41 from being opened when the lead wire 4 is pushed in between them, and to prevent the lead wire 4 from disengaging from the blades 41.

In FIGS. 11 through 14 showing the solderless terminal 60, parts corresponding functionally to those which have been described with reference to FIGS. 1 through 5 showing the solderless terminal 30 are therefore designated by the same reference numerals or characters.

With the solderless terminal in which the side walls 47 have the recesses 61 in the inner surfaces, the insulating cover 3 of the lead wire 4 is allowed to expand in the recesses 61 when the wire is pushed in between the side walls 47, which reduces the load which is applied to the side walls 47 when the insulating cover 3 expands, thereby to prevent the conductor connecting blades 41 from being opened.

On the other hand, since the side walls are partially decreased in wall thickness to form the recesses 61, the solderless terminal 60 is correspondingly reduced in weight.

In the solderless terminal of the invention, the side walls 47 are higher in mechanical strength than those in the conventional solderless terminal which have the cut-outs to allow the insulating cover 3 to expand. Hence, the terminal of the invention is free from the difficulties in which the side walls 47 or the conductor clamping blades 41 become deformed when the lead wire is pushed in between them.

Figure 22:
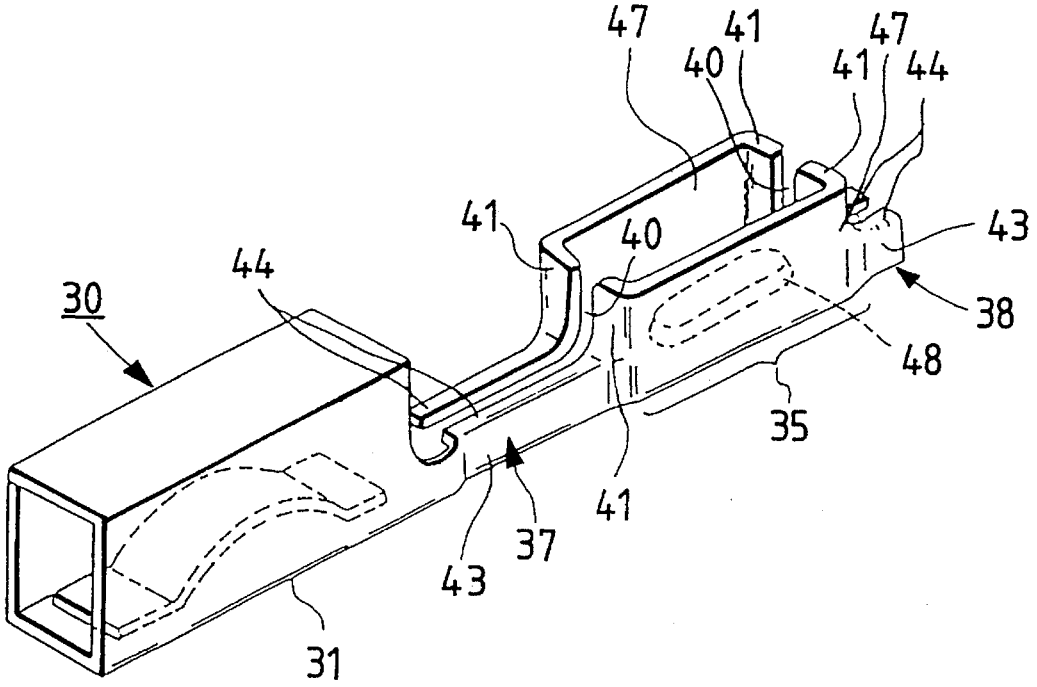
FIG. 22 is a perspective view showing one modification of the solderless terminal according to the invention.

In the above-described embodiments of the invention, the lead-wire fixing portion adapted to hold a lead wire through the insulating cover forms the rear end portion of the solderless terminal; however, the invention is not limited thereto or thereby. That is, the solderless terminal may be modified as shown in FIG. 22. The solderless terminal 30 shown in FIG. 22 has a first constricted portion 37 at the front end of the conductor connecting portion 35 and a second constricted portion 37 at the rear end of the latter 35. The first and second constricted portions 37 and 38 have reinforcing walls 43 and 44 which are formed by drawing similarly as in the cases of the above-described embodiments. However, the solderless terminal 30 has no lead-wire fixing portion, such as the one 34 shown in FIG. 1, at the rear end.

In FIG. 22 showing the modification, parts corresponding functionally to those which have been described with reference to FIG. 1 are therefore designated by the same reference numerals or characters. The solderless terminal 30 having no lead-wire fixing portion 34 is coupled to a connector housing which has a function of fixing a lead wire.

As was described above, in the solderless terminal of the invention, the first constricted portion at the front of the conductor connecting portion and the second constricted portion at the rear of the conductor connecting portion are of a cubic structure with both sides of the bottom plate being bent inwardly to form the right and left reinforcing walls. The resultant constricted portions are much higher in mechanical strength than those of the conventional solderless terminal which are merely flat plates. Hence, even when the solderless terminal is decreased in size and weight by reducing the thickness of the plate material to be used for fabrication of the terminal, the resultant terminal is free from the difficulty associated with a decrease in mechanical strength resulting in deformation.

In the conductor connecting portion, the conductor clamping blades forming the core-wire contact slots are formed by bending the side walls by drawing in such a manner that they are integral with the reinforcing walls of the constricted portions. Hence, the conductor clamping blades and the side walls are sufficiently high in mechanical strength. Hence, even when the solderless terminal is decreased in size and in weight by reducing the thickness of the plate material to be used for fabrication of the terminal, the resultant terminal is high in mechanical strength, and the blades are prevented from being opened when the lead wire is pushed in between them; that is, the terminal is maintained electrically connected to the conductor of the lead wire with high reliability.

In the first and second constricted portions, the reinforcing walls extending on both sides of the bottom plate are bent in such a manner that they overlap each other. The bending of the reinforcing walls in this manner increases the mechanical strength of the constricted portions more readily. Therefore, even when the solderless terminal is decreased in size and in weight by reducing the thickness of the plate material to be used for fabrication of the terminal, the resultant terminal does not experience a reduction in mechanical strength. The side walls of the conductor connecting portion, being integral with the constricted portion, are increased in rigidity. Hence, the conductor clamping blades are more positively prevented from being opened when the lead wire is forced in between them.

With the solderless terminal in which the side walls of the conductor connecting portion have the recesses in the inner surfaces, the insulating cover of the lead wire is allowed to expand in the recesses when the lead wire is pushed in between the side walls, which reduces the load which is applied to the side walls when the insulating cover expands, thereby to prevent the conductor connecting blades from being opened.

On the other hand, the formation of the recesses in the side walls of the conductor connecting portion results in a reduction in weight of the terminal. In addition, in the solderless terminal of the invention, the side walls of the conductor connecting portion is higher in mechanical strength than those in the conventional solderless terminal which have the cut-outs to allow the insulating cover to expand. Hence, the terminal of the invention is free from the difficulties that the side walls or the conductor clamping blades are deformed when the lead wire is pushed in between them.

What is claimed is:

1. A solderless terminal, comprising:

an electrical contact portion located at a front end portion of said terminal, said electrical contact portion being engageable with a mating connecting terminal;

a conductor connecting portion having a core-wire contact slot provided therein, said core-wire contact slot being defined by a pair of opposing conductor clamping blades adapted to cut an insulating cover of a lead wire and retain the conductor of said lead wire to thereby electrically connect said terminal to the conductor of said lead wire; and a constricted portion merging with said conductor connecting portion, wherein said constricted portion has a cubic shape defined by a bottom plate and opposing side walls, said side walls being bent inwardly to form right and left reinforcing walls, wherein said conductor connecting portion has right and left side walls which are confronted with each other to accommodate a part of said lead wire which is to be pushed in said conductor connecting portion, and wherein an end portion of each of said right and left side walls is bent inwardly substantially in the same direction as said reinforcing walls of said constricted portions to form said conductor clamping blades.

2. A solderless terminal as claimed in claim 1, wherein recesses are formed in the respective inner surfaces of said right and left side walls of said conductor connecting portion to permit the insulating cover of said lead wire to expand when said lead wire is pushed in said conductor connecting portion.

3. A solderless terminal of claim 1, further comprising a fixing portion located at a rear end of said terminal for clamping said insulating cover of said lead wire.

4. A solderless terminal of claim 1, wherein said right and left reinforcing walls of said constricted portion are parallel to said bottom plate thereof.

5. A solderless terminal as claimed in claim 1, wherein said right and left reinforcing walls of said constricted portion are bent so that said right and left reinforcing walls are folded over each other.

6. A solderless terminal as claimed in claim 5, wherein recesses are formed in the respective inner surfaces of said right and left side walls of said conductor connecting portion to permit the insulating cover of said lead wire to expand when said lead wire is pushed in said conductor connecting portion.

7. A solderless terminal as claimed in claim 1, wherein a bottom surface of said conductor connecting portion includes a wire stopper for limiting the depth of insertion of said lead wire in said conductor connecting portion.

8. A solderless terminal of claim 7, wherein said wire stopper includes an upwardly extending indentation provided in said bottom surface upon which said lead wire rests.

9. A solderless terminal, comprising:

an electrical contact portion located at a front end portion of said terminal, said electrical contact portion being engageable with a mating connecting terminal;

a conductor connecting portion having at least two core-wire contact slots longitudinally spaced from each other along the longitudinal axis of said terminal, each of said core-wire contact slots being defined by a pair of opposing conductor clamping blades adapted to cut an insulating cover of a lead wire and retain the conductor of said lead wire to thereby electrically connect said terminal to the conductor of said lead wire;

a first constricted portion merging with the front of said conductor connecting portion; and a second constricted portion merging with the rear of said conductor connecting portion, wherein each of said first and second constricted portions having a cubic shape defined by a bottom plate and opposing side walls, said side walls being bent inwardly to form right and left reinforcing walls, wherein said conductor connecting portion has right and left side walls which are confronted with each other to accommodate a part of said lead wire which is to be pushed in said conductor connecting portion, and wherein the front and rear end portions of said right and left side walls are bent inwardly substantially in the same direction as said reinforcing walls of said constricted portions to form said conductor clamping blades.

10. A solderless terminal as claimed in claim 9, wherein recesses are formed in the respective inner surfaces of said right and left side walls of said conductor connecting portion to permit the insulating cover of said lead wire to expand when said lead wire is pushed in said conductor connecting portion.

11. A solderless terminal of claim 9, further comprising a fixing portion located at a rear end of said terminal for clamping said insulating cover of said lead wire.

12. A solderless terminal of claim 9, wherein said right and left reinforcing walls of each of said first and second constricted portions are parallel to said bottom plate thereof.

13. A solderless terminal as claimed in claim 9, wherein said right and left reinforcing walls of each of said first and second constricted portions are bent so that said right and left reinforcing walls are folded over each other.

14. A solderless terminal as claimed in claim 13, wherein recesses are formed in the respective inner surfaces of said right and left side walls of said conductor connecting portion to permit the insulating cover of said lead wire to expand when said lead wire is pushed in said conductor connecting portion.

15. A solderless terminal as claimed in claim 9, wherein a bottom surface of said conductor connecting portion includes a wire stopper for limiting the depth of insertion of said lead wire in said conductor connecting portion.

16. A solderless terminal of claim 15, wherein said wire stopper includes an upwardly extending indentation provided in said bottom surface upon which said lead wire rests.

* * * * *